United States Patent [19]

Biemans et al.

[11] Patent Number: 4,904,151

[45] Date of Patent: Feb. 27, 1990

[54] LOADER LIFT ARM STRUCTURE

[75] Inventors: Marinus A. Biemans, Wainfleet; Henry Friesen, Niagara Falls, both of Canada

[73] Assignee: Deere & Company, Moline, Ill.

[21] Appl. No.: 216,060

[22] Filed: Jul. 7, 1988

[51] Int. Cl.[4] ..... B66F 9/08

[52] U.S. Cl. ..... 414/727; 172/817; 52/721; 403/167; 403/377

[58] Field of Search ..... 414/722, 727; 212/266; 182/228; 172/776, 817; 52/721, 731; 403/167, 377

[56] References Cited

U.S. PATENT DOCUMENTS

| | | | |
|---|---|---|---|
| 1,575,208 | 3/1926 | Jacobs | 403/167 X |
| 2,610,754 | 9/1952 | Inskeep | 414/727 |
| 3,254,780 | 6/1966 | Midtbo | 414/715 |
| 3,590,547 | 7/1971 | Molyneux et al. | 52/731 X |
| 4,098,350 | 7/1978 | Eftefield | 172/776 |
| 4,155,470 | 5/1979 | Moore et al. | 414/727 |
| 4,538,955 | 9/1985 | Langerfeld et al. | 414/722 X |
| 4,576,543 | 3/1986 | Kuchyt et al. | 414/722 |

FOREIGN PATENT DOCUMENTS

| | | | |
|---|---|---|---|
| 100807 | 9/1936 | Australia | 182/228 |
| 268062 | 1/1969 | Austria | 182/228 |
| 2379657 | 10/1978 | France | 414/722 |
| 2572474 | 5/1986 | France | 182/228 |
| 0738975 | 6/1980 | U.S.S.R. | 414/722 |

OTHER PUBLICATIONS

Model 158 John Deere Farm Loader, Operator's Manual OM-W37966, issue C6, published by Deere & Company in 1986, 80 pages.

Model 265 John Deere Farm Loader, Operator's Manual OM-W37957, issue L6, published by Deere & Company in 1986, 90 pages.

Easy-On Model 80 Front-end Loader, 1 page literature dated Sep. 9, 1982, published by EZEE-ON Manufacturing Lty. of Vegreville, Alberta, Canada.

Wil-Rich Field Cultivators, 12 pages, issue FC 6/83 10M-3, published by Wil-Rich Farm Equipment Division of Lear Siegler, Inc.

*Primary Examiner*—Robert J. Spar

*Assistant Examiner*—William M. Hienz

[57] ABSTRACT

There is disclosed a power loader lift arm cross tube stabilizing structure. A pair of loader lift arms are interconnected by a double torque tube stabilizing member which serves to distribute twisting forces encountered by one loader arm more evenly to that loader arm structure, as well as through the cross tube and to the other loader arm structure. The cross tube structure is comprised of two tubes, one positioned within the other, the outside tube being welded to each vertical side of each side of each lift arm member, while the inside tube is welded at its outer ends to the inner surface of the outer tube.

5 Claims, 2 Drawing Sheets

Fig. 1
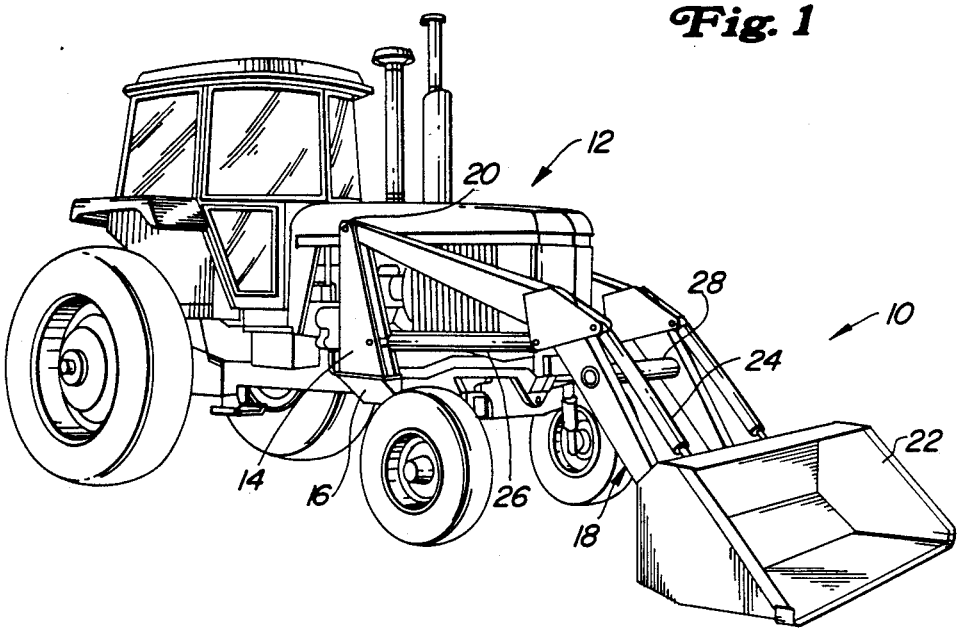
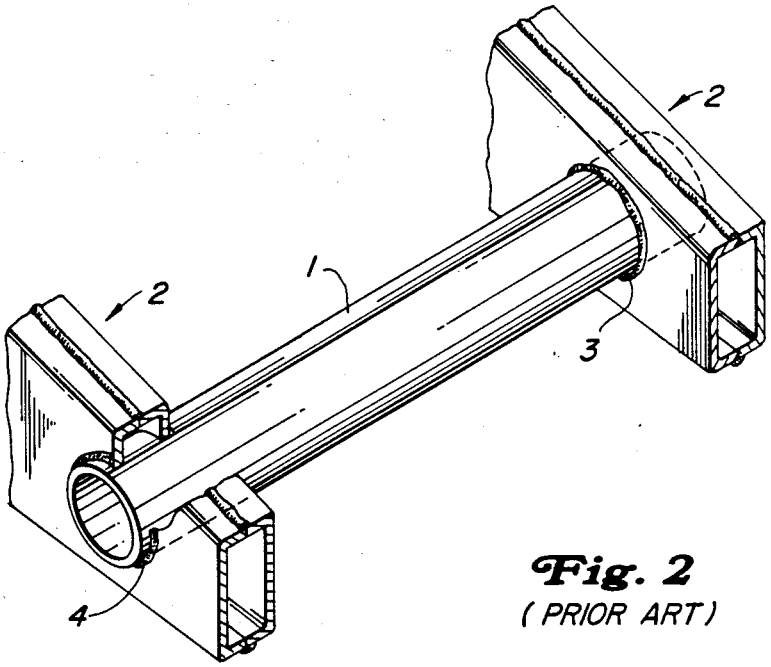
Fig. 2
(PRIOR ART)

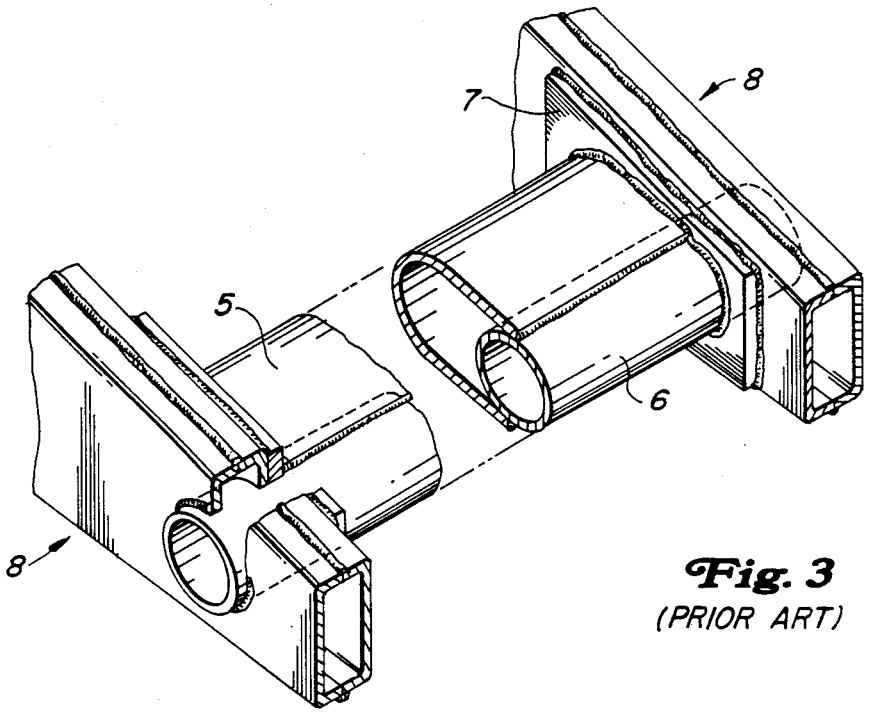
Fig. 3
(PRIOR ART)
Fig. 4
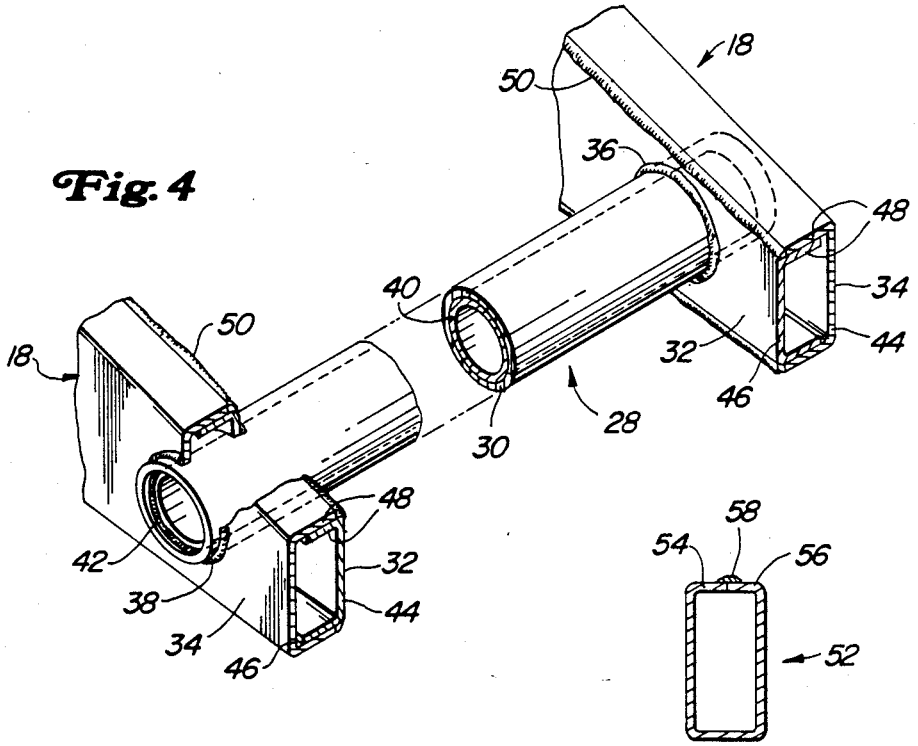
Fig. 5

LOADER LIFT ARM STRUCTURE

FIELD OF THE INVENTION

This invention relates to a power loader and in particular loader structure comprised of a pair of lift arms with a stabilizing member extending between them to increase the strength of the combined structure.

DESCRIPTION OF THE RELATED ART

Power loaders are typically mounted on a tractor and include a pair of lift arms pivoted at their rear ends and carrying at their forward ends structure adapted to mount a power loader bucket.

The lift arms are typically joined together forward of the tractor by various types of structures which extend between them to stabilize the entire assembly. Such stabilization is needed to counteract the twisting or torquing forces which may be encountered by each arm during digging or shoveling operations or as unevenly distributed loads are carried in the bucket.

One example of such a stabilizing structure that utilizes a single cross tube is found in U.S. Pat. No. 3,254,780 issued June 7, 1966 to Midtbo, assigned to Deere & Company, and illustrated in part in FIG. 2 of the drawings herein. This structure includes a cross tube designated by the number 1 mounted between lift arms designated 2. The tube 1 extends through the lift arms and is welded to both their inside and outside vertical surfaces at 3 and 4. This lift arm-cross tube structure has been extensively utilized by Deere and others for some time and has proven very useful in reducing the twisting encountered between power loader lift arms.

As front wheel drive tractors have gained in popularity and accordingly are used to mount power loaders, the twisting forces and resulting stresses encountered by loader lift arms have increased. This is the result of the front wheel drive tractors being able to achieve greater traction and therefore subject the buckets and other loader-mounted tools to higher driving, digging and loading forces. Consequently, stablizing tubes such as that illustrated in the Midtbo patent have been twisted with the welds connecting it to the arms being fractured. When the lift arms twist and/or the welds fail, the buckets or loader tools often become improperly oriented, making further loader operations time consuming and difficult.

One recent attempt to solve this problem is illustrated generally in FIG. 3 of this patent. It provided for a modified cross tube stabilizing structure, having a U-shaped member designated 5 welded to one side of the cross tube 6 and attached at its ends to face plates 7 carried by the inside surface of the loader arms 8. With this rigidifying structure, the occurrence of twisting damage to the lift arms and weld failures has been reduced. While this arrangement has proven satisfactory for many applications, it is very expensive to manufacture.

SUMMARY OF THE INVENTION

The present invention is directed to a new and improved cross tube stabilizing structure intended to counteract such twisting between the lift arms and minimize weld failures and tube deformations through reducing the torsional wind-up encountered by the tube.

Specifically, it is an object to distribute the twisting forces encountered by one loader arm more evenly to the opposite vertical sides of that arm's structure and then through the torque tube and more evenly between the opposite vertical surfaces of the other lift arm box-like structure. In each of the prior mentioned stabilizing structures, it has been found that approximately 90% of the forces encountered by a loader and transferred to the stabilizing structure are absorbed by the inside vertical surface of each lift arm at the location the stabilizing structure is connected to the arm. Only 10% was absorbed by the outside vertical lift arm surface at the location the stabilizing structure connects to the arm. Although the earlier mentioned modified tube (of FIG. 3) with its U-shaped reinforcing member and plate connection to the arms provided a more rigid connection between the arms, the force distribution upon the lift arm structures remained essentially the same as in the Midtbo structure illustrated in FIG. 2 hereof.

To distribute the forces more evenly upon the lift arm structures, a new cross tube structure is provided. This new structure is comprised of two tubes, one positioned within the other with the inside tube being welded to the outer ends of the outside tube. With this structure, use of the force absorbed by each boom arm is distributed to the inside vertical surface of that lift arm, while more of the force is distributed to the outside vertical surface of the lift arm. The exact percentage of forces distributed to the inside and outside vertical surfaces of the lift arms will vary with different lift arm sizing, spacing and cross tube dimensions. However, improved durability would be expected as the double torque tube arrangement redistributes the forces and reduces the twisting of each lift arm.

With this invention, the outer tube passes through both vertical walls of each arm and is welded to both the inside and outside vertical surfaces of the arm. The inside cross tube is in turn welded to the larger cross tube, but only at the outer ends of the larger tube.

In redistributing the forces between the inner and outer vertical faces of each lift arm, it has been found that an outer wall thickness which is thinner and an inner wall thickness which is heavier are desirable. The precise dimensions and relationship being dependent on lift arm sizes, cross tube width and relative spacing.

BRIEF DESCRIPTION OF THE DRAWINGS

Other advantages, objects and aspects of the present invention will become more apparent from the following detailed description taken in conjunction with the accompanying drawings, in which:

FIG. 1 is a pictorial representation of a power loader according to the present invention, mounted on an agricultural tractor.

FIG. 2 is an illustration of a partial loader lift arm and cross tube structure as provided in the prior art.

FIG. 3 is another illustration of a partial loader lift arm and cross tube structure also available in the prior art.

FIG. 4 is a partial view of a loader lift arm and cross tube stabilizing structure according to the present invention.

FIG. 5 is an end view of a lift arm structure utilizing an alternate construction for the lift arm.

DETAILED DESCRIPTION OF THE PREFERRED EMBODIMENT

Referring now to the drawings and initially to FIG. 1, there is illustrated a power loader 10 according to the present invention. The loader is supported on and extends forward of an agricultural tractor 12.

The loader 10 is comprised of a pair of upright posts or masts 14 seatably mounted on laterally extending frames 16 carried at each side of the tractor 12. It is carried at its forward end by the main frame of the tractor 12 and since such mounting arrangements are conventional, they need not be further described in detail.

The loader 10 includes a boom in the form of two lift arm structures 18 extending forwardly from transverse horizontal rear pivots 20 carried by the upright masts 14. The lift arms 18 project beyond the front of the tractor 12 and typically carry a bucket 22 or other tool. The bucket 22 is activated to rock about a pivotal connection with the lift arms 18 by cylinders 24. Similarly the arms 18 are swung about their rear pivotal mounting 20 with the masts 14 by extension and retraction of lift cylinders 26. The cylinders 26 are anchored at their rear with the masts 14 and at their forward ends with the lift arms 18.

Interconnecting the lift arms 18 at their forward portion so as to stabilize them and resist torsional stress encountered by one or both arms is the double torque tube designated 28.

In FIG. 4, which illustrates the preferred embodiment of the double torque tube and lift arm arrangement, there is shown in cut-away fashion portions of the respective left and right lift arm structures 18. The double torque tube 28 interconnects these structures 18. It is comprised of an outer tube 30 which is placed between the lift arms 18 and extends through openings which can be cut, drilled or otherwise provided in the two vertical walls 32 and 34 of each lift arm. It is welded at 36 and 38, it junctures with each vertical wall 32 and 34 of each lift arm 18. Housed inside the torque tube 30 is the second torque tube or inner torque tube 40. This second tube 40 is welded at 42, where its outer ends meet the outer ends of the outer tube 30. While the preferred embodiment provides for this weld 42 to be placed within the outer tube 30, the inner tube 40 could extend beyond the ends of the outer tube 30 with the weld being made to the outer surface of the inner tube to connect it to the outer tube 30.

While various means and structures can be used to construct the box-like structures of each lift arm 18, the preferred embodiment is illustrated in FIG. 4 and is comprised of two U-shaped channels 44 and 46 having their legs 48 overlapped and welded at 50. An alternative construction for the lift arm 18 is illustrated in FIG. 5 and is comprised of a single U-shaped member 52 having its legs 54 and 56 bent to abut. The abutting leg portions 54 and 56 are then welded as illustrated at 58.

Through utilizing the two separate torque tubes as explained, a more rigid stabilizing structure is provided. Through connecting them to the lift arms and to one another, the forces encountered by the loader are more evenly distributed to the lift arm structures and damage to the arms and welds are reduced.

We claim:

1. Lift arm structure for use in a power loader including a pair of laterally spaced, fore-and-aft extending lift arms, each arm being comprised of a generally tubular member having spaced apart inner and outer vertical walls;

and an improved torque tube structure extending between the two lift arms characterized by:

first and second rigid tubular members extending between the two arms, each member having an opposite end portion extending through the spaced apart inner and outer vertical walls of each arm;

the second rigid tubular member carried within the first rigid tubular member;

the first rigid tubular member being rigidly connected to the inner and outer vertical walls of each arm; and the second rigid tubular member being rigidly fastened to only the outer ends of the first rigid tubular member.

2. The invention described in claim 1 wherein the tubular member of each lift arm is constructed of two U-shaped channels with the legs of each U-shaped channel overlapping the legs of the other U-shaped channel and being welded thereto.

3. The invention described in claim 1 wherein the tubular member is comprised of a U-shaped channel with portions of each leg bent towards the other leg to abut and form a box-shaped channel, said legs being welded together at said abutment.

4. The invention described in claim 1 wherein the second tubular member is rigidly connected to the first tubular member in substantially the same plane occupied by the outer vertical wall.

5. The invention described in claim 4 wherein the second tubular member is rigidly connected to the first tubular member inwardly of the outer end of the first tubular member.

* * * * *